US007073275B2

(12) United States Patent
Hay

(10) Patent No.: US 7,073,275 B2
(45) **Date of Patent: *Jul. 11, 2006**

(54) SHOE SOLE WITH FOOT GUIDANCE

(75) Inventor: Gordon Graham Hay, Newtonville, MA (US)

(73) Assignee: Bivab, LLC, Marblehead, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/795,085

(22) Filed: Mar. 5, 2004

(65) Prior Publication Data

US 2005/0055845 A1 Mar. 17, 2005

Related U.S. Application Data

(62) Division of application No. 10/156,578, filed as application No. PCT/US02/01745 on Jan. 23, 2002, now Pat. No. 6,701,642.

(60) Provisional application No. 60/323,421, filed on Sep. 18, 2001.

(30) Foreign Application Priority Data

Jan. 24, 2001 (IT) ..... MI2001A0125

(51) Int. Cl.

| | |
|---|---|
| ***A43B 13/00*** | (2006.01) |
| ***A43B 13/18*** | (2006.01) |
| ***A43B 13/22*** | (2006.01) |
| ***A43C 15/00*** | (2006.01) |

(52) U.S. Cl. ..... 36/25 R; 36/59 C; 36/114; 36/67 R; 36/30 R

(58) Field of Classification Search ..... 36/25 R, 36/59 C, 103, 32 R, 102, 114, 28, 30 R, 67 R, 36/141, 67 A, 31
See application file for complete search history.

(56) References Cited

U.S. PATENT DOCUMENTS

| | | | |
|---|---|---|---|
| 2,710,461 | A | 6/1955 | Hack |
| 4,307,521 | A | 12/1981 | Inohara et al. |
| 4,364,190 | A | 12/1982 | Yonkers |
| 4,402,145 | A | 9/1983 | Dassler |
| 4,510,700 | A | 4/1985 | Brown |
| 4,538,366 | A | 9/1985 | Norton |
| 4,641,438 | A | 2/1987 | Laird et al. |
| 5,203,097 | A | 4/1993 | Blair |
| 6,176,025 | B1 | 1/2001 | Patterson et al. |

FOREIGN PATENT DOCUMENTS

| | | |
|---|---|---|
| GB | 2 113 072 | 1/1993 |
| WO | 99/48396 | 9/1999 |

*Primary Examiner*—Anthony Stashick
(74) *Attorney, Agent, or Firm*—Davis & Bujold, P.L.L.C.

(57) ABSTRACT

A sole for a shoe with a foot guiding mechanism which has the particularity that the sole comprises a sole body which has, on an outer face thereof, at least one protrusion. The at least one protrusion is flexible in order to produce a desired movement of the protrusion which is suitable to force a guided sequence for a foot, wearing the shoe sole, from when the heel section initially contacts a ground surface to when the front edge of the sole breaks contact with the ground surface.

33 Claims, 8 Drawing Sheets

SHOE SOLE WITH FOOT GUIDANCE

This application is a divisional application of Ser. No. 10/156,578 filed May 24, 2002, now U.S. Pat. No. 6,701,642, which is a national stage completion of PCT/US02/01745 filed Jan. 23, 2002 which claims benefit of provisional Ser. No. 60/323,421 filed Sep. 18, 2001.

FIELD OF THE INVENTION

This invention relates to shoe soles and, more specifically, to an improved shoe sole that guides the foot as the user walks or runs with a shoe incorporating the improved shoe sole.

BACKGROUND OF THE INVENTION

Shoe soles are well known in the prior art. Soles made of a resilient material provide additional comfort for the user and store a portion of energy generated during a step or stride. Shoe soles, however, have not been produced that conform the sole to the natural walking or running pattern of a foot engaging the ground. That is, the prior art soles do not guide the foot along a natural walking or running path of a user of the sole. If the sole were to accommodate the natural pattern of a foot engaging the ground, the comfort and efficiency of a sole could be improved.

A foot typically contacts the ground at the outer portion of the heel. As the step advances, a greater portion of the heel, along with the outer portion of the arch of the foot, then contacts the ground. Next, the inner portion of the ball of the foot contacts the ground. Following the contact by the inner ball of the foot, the remainder of the ball of the foot and the toes contact the ground. At this point, the foot is generally flat on the ground. As the heel begins to leave the ground, weight is transferred to the ball of the foot. After the heel and arch leave the ground, most of a person's weight is concentrated on the inner portion of the ball of the foot. As the foot begins to leave the ground, the inner portion of the ball of the foot and the big toe are the last areas to be in contact the ground. The above described natural pattern of contact between the foot and the ground can, generally, be called an S-shape path. That is, as a step advances, the point of contact is, in order, at the following locations: the heel, the outer arch, the inner ball, and the outer ball.

Prior art soles do not provide a means for guiding the foot along this natural path. Prior art soles may have protruding portions which are designed to constitute an elastic shock absorber so as to be able to absorb the impact that typically occurs during walking or running, for example. However, these protrusions typically force the foot away from the natural S-shaped path. That is, prior art protrusions create zones that pull the foot away from the natural path, force early pronation, and/or force the foot to move internally. While these protruding portions may be helpful for their intended purpose, efficiency and comfort could be improved by taking advantage of the natural S-shaped path or pattern of a step.

There is, therefore, a need for a sole having protrusions structured to induce or to force a guided sequence of movement of the foot from the instance when the heel contacts the ground to the instance when the big toe leaves the ground to improve walking comfort of a user of the shoe sole.

Within the scope of this aim, a particular object of the invention is to provide a sole which, in a way, induces the foot to gradually move along a path outlined on the basis of the classic concepts of biomechanics applied to walk analysis.

Another object of the present invention is to provide a sole for shoes with foot guiding means which, by virtue of the particular constructive characteristics of the sole, is capable of providing the greatest assurances of reliability and safety during use.

Another object of the present invention is to provide a sole which can be altered, in each instance, according to the specific sport or activity for which it is applied and according to the type of movement to be performed.

SUMMARY OF THE INVENTION

These and other needs are solved by the invention which provides a sole having, on the sole lower surface, a plurality of protrusions structured to force a guided sequence of movement of the foot from the instance when the heel initially contacts the ground to the instance when the big toe breaks contact with the ground. The protrusions on the lower surface are made from a resilient material and include some protrusions that are more flexible than other portions which tend to be more rigid. That is, the material that forms the protrusion may have a different areas or sections with different resiliencies. Alternatively, the protrusions may be located opposite or adjacent to an air chamber in the sole so that, during a stride, the protrusion may flex inward into the air chamber. Alternatively, the protrusions may be angled in a desired orientation or arrangement to facilitate guiding the foot along a desired guided sequence as well. The orientation of the angled surfaces, the location of the air chambers, the size and/or orientation of the less resilient portions may vary, from application to application, so that the protrusions are programmed to have a pivot or bend axis, extending in a desired direction, to promote the natural or intended path. That is, for a sport where the user is more likely to move side to side, e.g. tennis, the some or many of axes may extend, generally, in the direction of the longitudinal axis of the sole. However, where the user is more likely to move generally forward, e.g. running, the axes of the protrusions will extend generally perpendicular to the longitudinal axis of the sole.

Generally, there is at least one protrusion located at the rearward most portion of the heel portion of the sole, as well as other protrusions located along the outer side of the heel portion, and protrusions on the inner and outer sides of the ball of the foot portion promote the desired the path or guidance sequence of the foot.

Further characteristics and advantages will become apparent from the description of preferred but not exclusive embodiments of soles for shoes with foot guiding means.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
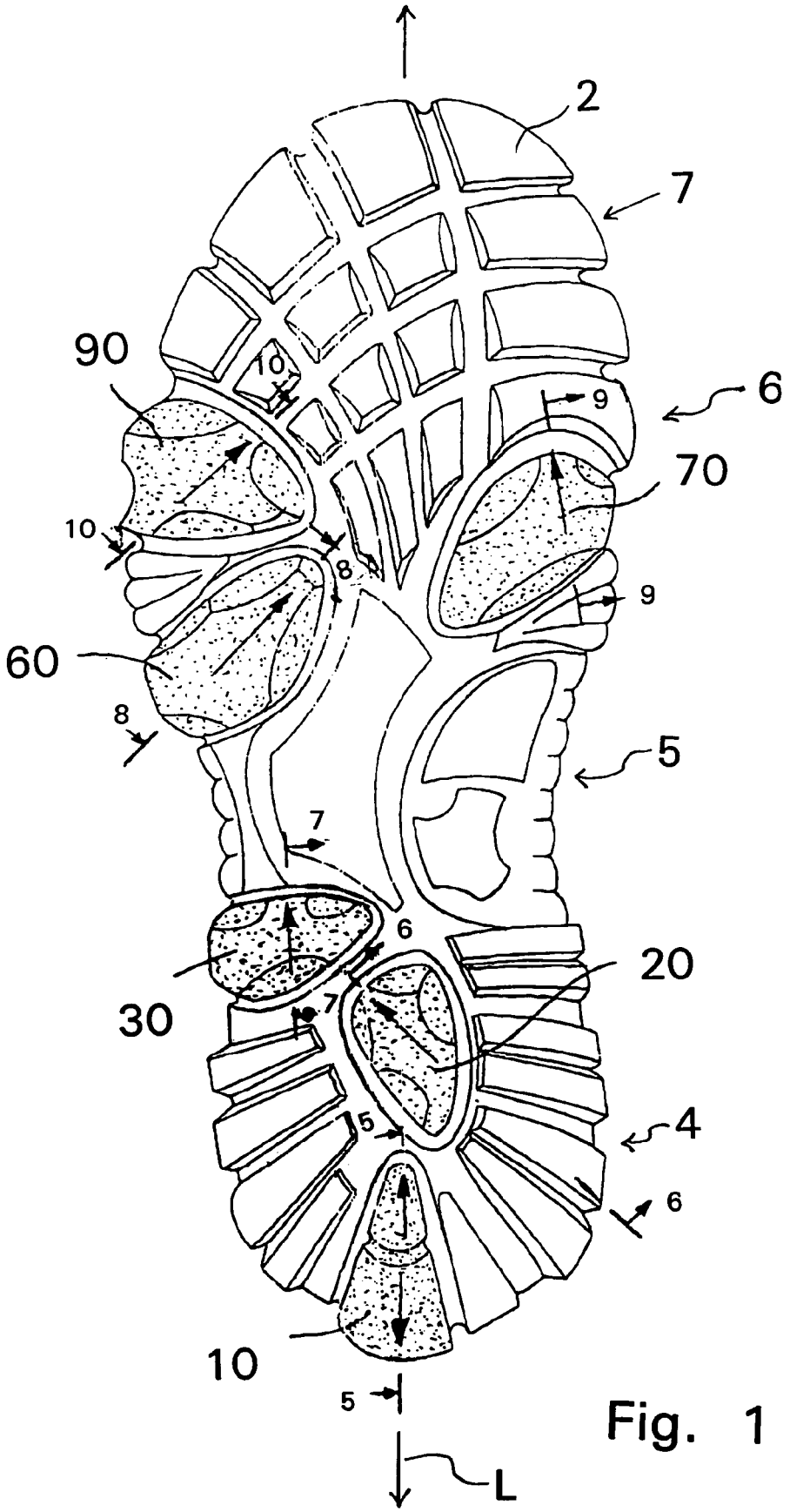
FIG. 1 is a schematic bottom plan view of the sole according to the invention, highlighting the main protrusions.

As shown is FIG. 1, the sole for a shoe with foot guiding means, according to the invention, is generally designated by reference numeral 1. The sole 1 is typically manufactured from thermoplastic, rubber, EVA, or a urethane material. The sole 1 comprises a sole body which can have a variety of different shapes, configurations and sizes. The protrusions can also have a variety of different shapes, configurations and arrangements which can vary depending upon desired orientation of the oscillation axis to be achieved.

The sole 1 has a bottom ground engaging surface 2, a top inner sole engaging surface 3 (FIG. 4), a heel section 4, an arch section 5, a ball of the foot section 6 and a toe section 7. The side of the sole 1 that is structured to contact a user's big toe is referred to as the "inner side" of the sole 1, while the side of the sole 1 that is structured to contact the user's little toe is referred to as the "outer side" of the sole 1. A plurality of protrusions project or extend from the bottom surface 2 and each of these protrusions will be described below in further detail. The protrusions are structured to produce or induce a desired foot movement which is suitable to force a guided sequence of movement of the foot from the instance when the heel initially contacts the ground to the instance when the big toe finally breaks contact with the ground.

Taking as an example the illustrated sole which, in practice, is meant for walking, the protrusions are designed and arranged so as to produce, during a normal walking stride, an S-shaped path or movement for the foot.

The movement of the protrusions is achieved by utilizing the different elastic yielding configurations of the material from which the sole is manufactured. That is, the sole is usually made from rubber or some other thermoplastic or thermosetting elastomeric material so that different thicknesses or thinnesses of material produce different elastic yielding or flexing properties.

Figure 2:
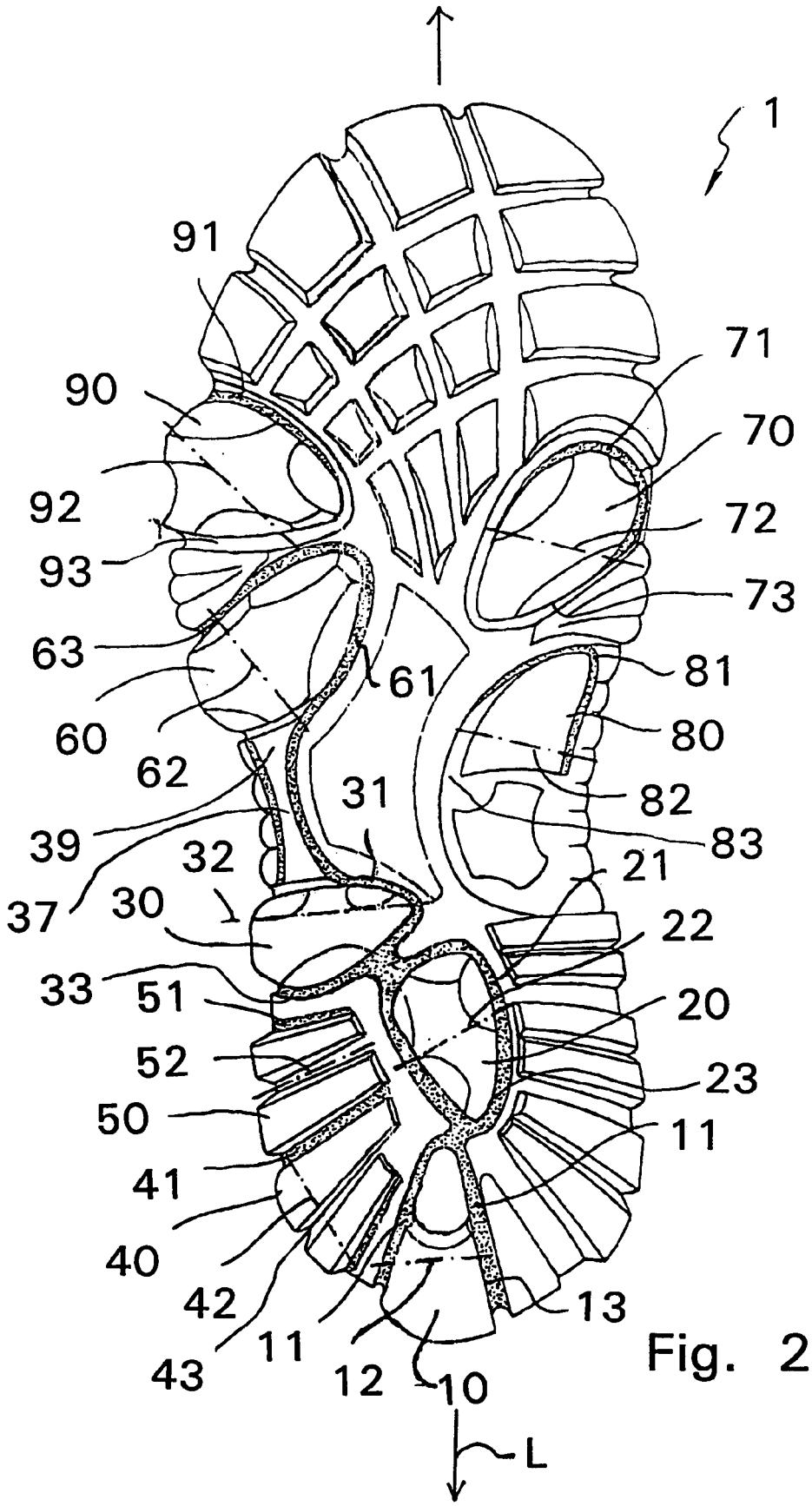
FIG. 2 is a bottom plan view of the sole which highlights the protrusions and the oscillation axes.

As shown in FIGS. 1 and 2, the sole bottom surface 2 includes a rear most protrusion 10. The rear most protrusion 10 is generally a triangle shaped protrusion with a base of the triangle shaped protrusion coincident with the perimeter of the sole 1 and a vertex of the triangle shaped protrusion is pointed toward the arch section 5 of the sole. The rear most protrusion 10 is located along the longitudinal axis L so as to be positioned slightly closer to outer side than to the inner side of the sole. The rear most protrusion 10 has a weaker portion 11, located spaced from the perimeter of the sole 1, and a more rigid or stronger portion 13, located proximate to the perimeter of the sole 1. A first oscillation axis 12 is thus formed which extends in a direction generally transverse to the longitudinal axis L of the sole 1.

Alternatively, the weaker portion 11 can completely surround the entire circumference of the rear most protrusion 10, to provide a suspension area or zone which facilitates guidance of or creates a positioning effect on the foot, or a more rigid portion 13 can completely surround the entire circumference of the rear most protrusion 10 so that the rear most protrusion 10 induces a biasing force on the foot for guiding the foot in a desired direction depending upon the desired programming characteristics of the sole.

A central protrusion 20 is formed in the sole 1 proximate to the vertex of the rear most protrusion 10. The central protrusion 20 also has a weaker portion 21, located adjacent the heel portion 4, and a stronger portion 23, located proximate to the vertex of the rear most protrusion 10. The central protrusion 20 defines a second oscillation axis 22 which is substantially at an angle with respect to the longitudinal axis L of the sole 1. The second oscillation axis 22 is angled such that a line normal to the forward side of the second oscillation axis 22 extends toward the outer side of the sole 1. The rear most protrusion 10 is designed to absorb the impact of the heel portion striking the ground, accumulate and transmit energy toward the internal portion in order to create a thrust force toward the central protrusion 20 which also absorbs the impact and is meant to absorb the energy transmitted by the rear most protrusion 10 and send the energy toward an outer rear arch protrusion, designated by the reference numeral 30, of the lateral longitudinal arch.

Alternatively, the weaker portion 21 can completely surround the entire circumference of the central protrusion 20, to provide a suspension area or zone which facilitates guidance of or creates a positioning effect on the foot, or a more rigid portion 23 can completely surround the entire circumference of the central protrusion 20 so that the central protrusion 20 induces a biasing force on the foot for guiding the foot in a desired direction depending upon the desired programming characteristics of the sole.

The outer rear arch protrusion 30 is located on the outer side of the sole 1, adjacent to the central protrusion 20. A forward portion of the outer rear arch protrusion 30 is a weaker portion 31 while a remainder of the outer rear arch protrusion 30 is a more rigid portion 33. Thus, a third oscillation axis 32 is defined by the outer rear arch protrusion 30. The third oscillation axis 32 extends in a direction generally transverse to the longitudinal axis L of the sole 1.

Alternatively, the weaker portion 31 can completely surround the entire circumference of the outer rear arch protrusion 30, to provide a suspension area or zone which facilitates guidance of or creates a positioning effect on the foot, or a more rigid portion 33 can completely surround the entire circumference of the outer rear arch protrusion 30 so that the outer rear arch protrusion 30 induces a biasing force on the foot for guiding the foot in a desired direction depending upon the desired programming characteristics of the sole.

A first outer lateral rear protrusion 40 is disposed between the central protrusion 20 and an outer perimeter of the sole 1. The first outer lateral rear protrusion 40 also has a weaker portion 41 disposed between the first outer lateral rear protrusion 40 and lateral longitudinal arch while a remainder of the outer lateral rear protrusion 40 is a more rigid portion 43. Thus, a fourth oscillation axis 42 is formed and extends at a slight angle toward the outer side and transverse to the longitudinal axis L of the sole 1. The first outer lateral rear protrusion 40 is designed to absorb the impact of the sole with the ground and to store this energy and direct the same toward the central protrusion 20.

Alternatively, the weaker portion 41 can completely surround the entire circumference of the outer lateral rear protrusion 40, to provide a suspension area or zone which facilitates guidance of or creates a positioning effect on the foot, or a more rigid portion 43 can completely surround the entire circumference of the outer lateral rear protrusion 40 so that the outer lateral rear protrusion 40 induces a biasing force on the foot for guiding the foot in a desired direction depending upon the desired programming characteristics of the sole.

A second outer lateral rear protrusion 50 is located on the arch section 5 adjacent to the heel section 4. The second outer lateral rear protrusion 50 is disposed adjacent to the outer side of the sole 1, just forward of the outer lateral protrusion 40. The second outer lateral rear protrusion 50 includes a weak portion located toward a forward side of the second outer lateral rear protrusion 50. Thus, a fifth oscillation axis 52 is formed by the second outer lateral rear protrusion 50. The fifth oscillation axis 52 extends generally in a direction transverse to the longitudinal axis L of the sole and generally perpendicular to the fourth oscillation axis 42 so as to produce a transfer of the energy toward the outer rear arch protrusion 30 of the arch.

Alternatively, the weaker portion 51 can completely surround the entire circumference of the second outer lateral rear protrusion 50, to provide a suspension area or zone which facilitates guidance of or creates a positioning effect on the foot, or a more rigid portion can completely surround the entire circumference of the second outer lateral rear protrusion 50 so that the second outer lateral rear protrusion 50 induces a biasing force on the foot for guiding the foot in a desired direction depending upon the desired programming characteristics of the sole.

An outer forward arch protrusion 60 is located at the forward end of the arch portion 5, adjacent to the outer side of sole 1. A bridge 37 extends between the rear arch protrusion 30 and the forward arch protrusion 60. The bridge 37 includes a suspended protrusion 39 which contacts the ground when the rear arch protrusion 30 and the forward arch protrusion 60 are in compression.

The forward arch protrusion 60 includes a weaker portion 61, spaced from the outer side of the sole 1 thereby creating a sixth oscillation axis 62 while a remainder of the forward arch protrusion 60 is a more rigid portion 63. The sixth oscillation axis 62 is angled relative to the longitudinal axis L of sole 1 so as to be inclined toward a median axis and produce movement of the foot toward a metatarsal protrusion 70 which is arranged on the inner side edge of the sole, at the front part of a medial longitudinal arch. A line extending normal to the sixth oscillation axis 62 extends substantially toward a region where the big toe normally contacts the sole 1.

Alternatively, the weaker portion 61 can completely surround the entire circumference of the outer forward arch protrusion 60, to provide a suspension area or zone which facilitates guidance of or creates a positioning effect on the foot, or a more rigid portion 63 can completely surround the entire circumference of the outer forward arch protrusion 60 so that the outer forward arch protrusion 60 induces a biasing force on the foot for guiding the foot in a desired direction depending upon the desired programming characteristics of the sole.

The metatarsal protrusion 70 is located, on the inner side of the sole 1, opposite the forward arch protrusion 60. The metatarsal protrusion 70 includes a forward facing weaker portion 71 while a remainder of the metatarsal protrusion 70 is a more rigid portion 73 thereby creating a seventh oscillation axis 72. The seventh oscillation axis 72 is generally perpendicular to the longitudinal axis L of the sole 1. The seventh axis 72 extends substantially normal to the longitudinal axis L of the shoe sole and a line extending normal to the seventh oscillation axis 72 extends substantially toward a region where the big toe leaves the ground so as to create a component which facilitates separation of the sole from contact with the ground.

Alternatively, the weaker portion 71 can completely surround the entire circumference of the metatarsal protrusion 70, to provide a suspension area or zone which facilitates guidance of or creates a positioning effect on the foot, or a more rigid portion 73 can completely surround the entire circumference of the metatarsal protrusion 70 so that the metatarsal protrusion 70 induces a biasing force on the foot for guiding the foot in a desired direction depending upon the desired programming characteristics of the sole.

An inner arch protrusion 80 is disposed between the central protrusion 20 and the metatarsal protrusion 70. The inner arch protrusion 80 includes a forward facing weaker portion 81 while a remainder of the inner arch protrusion 80 is a more rigid portion 83 thereby creating an eighth oscillation axis 82. The eighth oscillation axis 82 extends substantially perpendicular to the longitudinal axis L of the shoe sole and parallel to the seventh oscillation axis 72. A line extending normal to the eighth oscillation axis 82 extends substantially toward a forward inner side of the sole 1.

Alternatively, the weaker portion 81 can completely surround the entire circumference of the inner arch protrusion 80, to provide a suspension area or zone which facilitates guidance of or creates a positioning effect on the foot, or a more rigid portion 83 can completely surround the entire circumference of the inner arch protrusion 80 so that the inner arch protrusion 80 induces a biasing force on the foot for guiding the foot in a desired direction depending upon the desired programming characteristics of the sole.

The sole 1 is completed by a lateral planter protrusion 90 disposed adjacent to but in front of the forward arch protrusion 60. The lateral planter protrusion 90 includes a forward most weaker portion 91 while a remainder of the lateral planter protrusion 90 is a more rigid portion 93 thereby creating a ninth oscillation axis 92. The ninth oscillation axis 92 extends substantially parallel to the sixth oscillation axis 62 and a line extending normal to the ninth oscillation axis 92 extends toward the opposite edge of the sole 1 at a region where the big toe would contact the sole 1.

Alternatively, the weaker portion 91 can completely surround the entire circumference of the lateral planter protrusion 90, to provide a suspension area or zone which facilitates guidance of or creates a positioning effect on the foot, or a more rigid portion 93 can completely surround the entire circumference of the lateral planter protrusion 90 so that the lateral planter protrusion 90 induces a biasing force on the foot for guiding the foot in a desired direction depending upon the desired programming characteristics of the sole.

A sole with a plurality of protrusions 10, 20, 30,40, 50, 60, 70, 80, 90 located in the disclosed configuration, as shown in FIGS. 1–11, imparts directionality to the foot of the user thereby guiding the foot along a definite path which can generally be likened to the natural S-shaped path. The protrusions 10, 20, 30,40, 50, 60, 70, 80, 90 also absorb energy during a step by virtue of the protrusions 10, 20, 30, 40, 50, 60, 70, 80, 90 ability to yield, compress and/or and flex inward when subjected to ground contact pressure. The degree of energy absorbed or cushioning provided by the protrusions 10, 20, 30,40, 50, 60, 70, 80, 90 is controlled by the height of the protrusion, i.e., the degree that the protrusion extends from the bottom surface in relationship to a remainder of the bottom of the shoe sole, the rigidity or semirigidity of the elements disposed adjacent to and/or the rigidity or semirigidity of the side walls supporting the protrusions 10, 20, 30,40, 50,60, 70, 80, 90. The protrusions 10, 20, 30, 40, 50, 60, 70, 80, 90 also increase traction for the user of the sole as the protrusions are designed to contact the ground prior to a remainder of the shoe sole. In addition, because compression of one side of the protrusions 10, 20, 30, 40, 50, 60, 70, 80, 90 may cause the opposite side of the protrusion to be slightly protruded or extended, depending upon the protrusion design, whereby the protrusions 10, 20, 30, 40, 50, 60, 70, 80, 90 can be designed to facilitate better gripping or holding with a ground surface, even when a user is walking down a hill.

Figure 3:
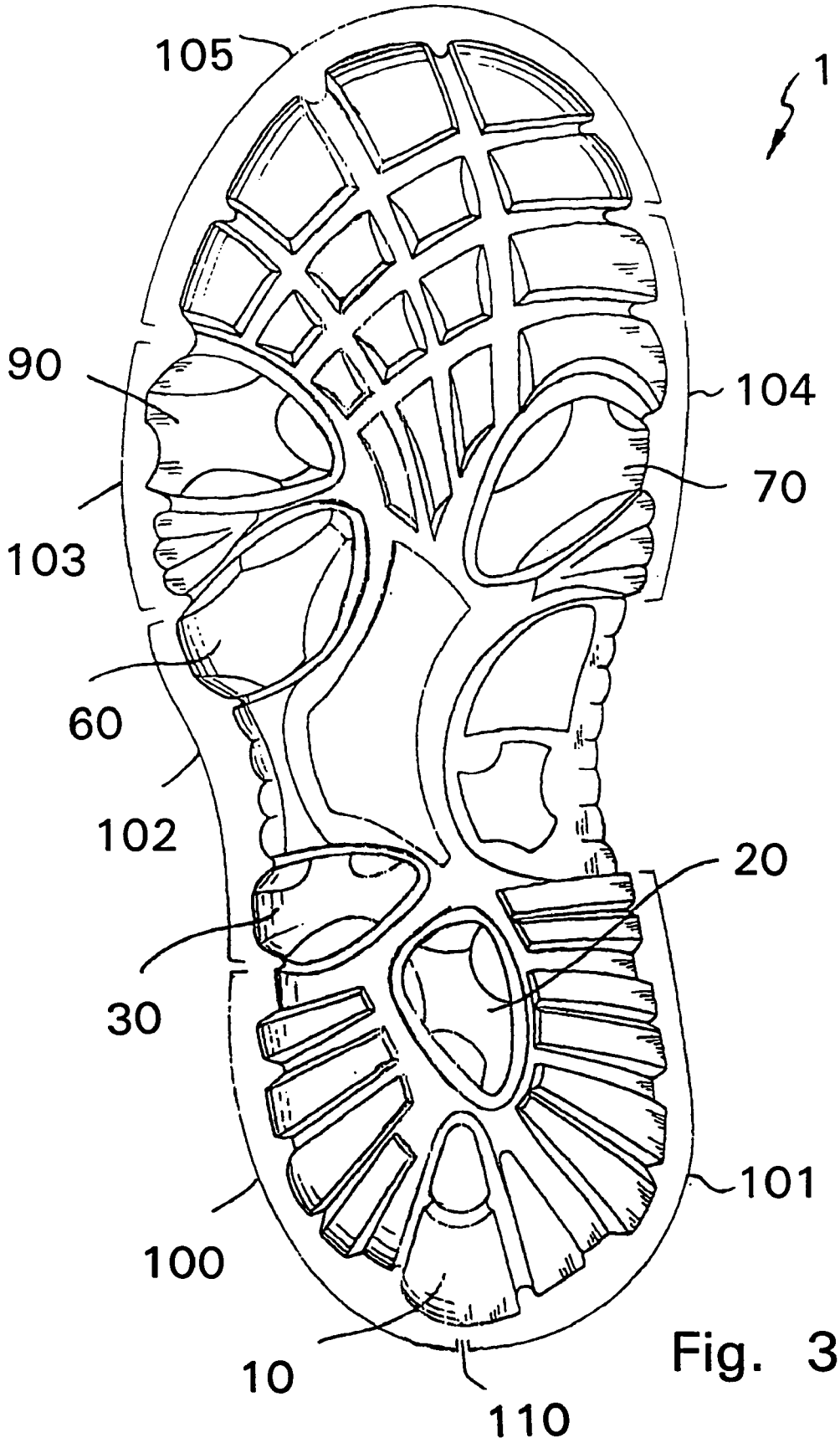
FIG. 3 is a bottom plan view of the sole, highlighting the shape of the peripheral lateral edge.

The protrusions 10, 20, 30, 40, 50, 60, 70, 80, 90 form a particular configuration having lateral edges which can have an important role in the foot guiding function. As shown in FIG. 3, the lateral profile of the various protrusions 10,20, 30,40, 50,60,70,80,90 vary locally from sharp edges, e.g. 90 degree edges, to rounded and protruding edges so as to affect the rolling action and promote movement of the load along a definite path. The arrangement of the described protrusions imparts a directionality to the foot, guiding the foot along a definite path which can essentially be likened to an S-shape path.

In particular, as generally shown in FIG. 3, the lateral profile of the various protrusions can vary locally from a sharp edge, e.g. a 90 degree or less edge, to non-sharp rounded edges so as to affect the rolling action and promote the movement of the load along a definite path. In particular, a rounded profile 100 of the lateral portion of the heel section 4 (see FIG. 3) is provided along the outer side of the heel section 4 and the rounded profile 100 facilitates a rolling action, while the heel section 4 is in contact with the ground, and limits the onset of friction caused by the initial contact of the heel section 4. Generally, contact with the ground occurs at the outer lateral part of the heel section 4 and continues forward along the outer part of the heel section 4 parallel to the longitudinal axis L of the sole 1. The inner side of the heel section 4, on the other hand, has a sharp edge 101 which extends forward up to the inner arch section 5. The sharp edge 101 substantially affects the lateral portion up to the plantar arch region. A transition from the rounded profile 100 to the sharp edge occurs is designated by 110. For most individuals, initial ground contact or impact by a shoe sole occurs at the rear lateral part of the heel section 4 and continues forward in a lateral direction.

During the middle phase of a step, the weight of the user moves forward on the sole 1 and affects the rear arch protrusion 30 and the forward arch protrusion 60. The peripheral edge of both the rear arch protrusion 30 and the forward arch protrusion 60, which affect the arch region, have rounded edges and are designated by the reference numeral 102. Conversely, the lateral plantar protrusion 90, located just in front of the forward arch protrusion 60, has a sharp, substantially 90 degree or less edge 103. Thus, as the step progresses during the central part of the step, the foot is directed by the sharp, substantially 90 degree or less edge of the lateral plantar protrusion 90 toward the medial inner of the sole 1 and the foot is prevented from over rotating.

The metatarsal edge region, designated by the reference numeral 104, also has a sharp, substantially 90 degree edge, while the front curved edge 105 of the shoe sole has a rounded shape or edge in order to facilitate the lifting of the big toe from the ground, so that the foot completes the step cycle without being subjected to drag or friction.

Figure 4:
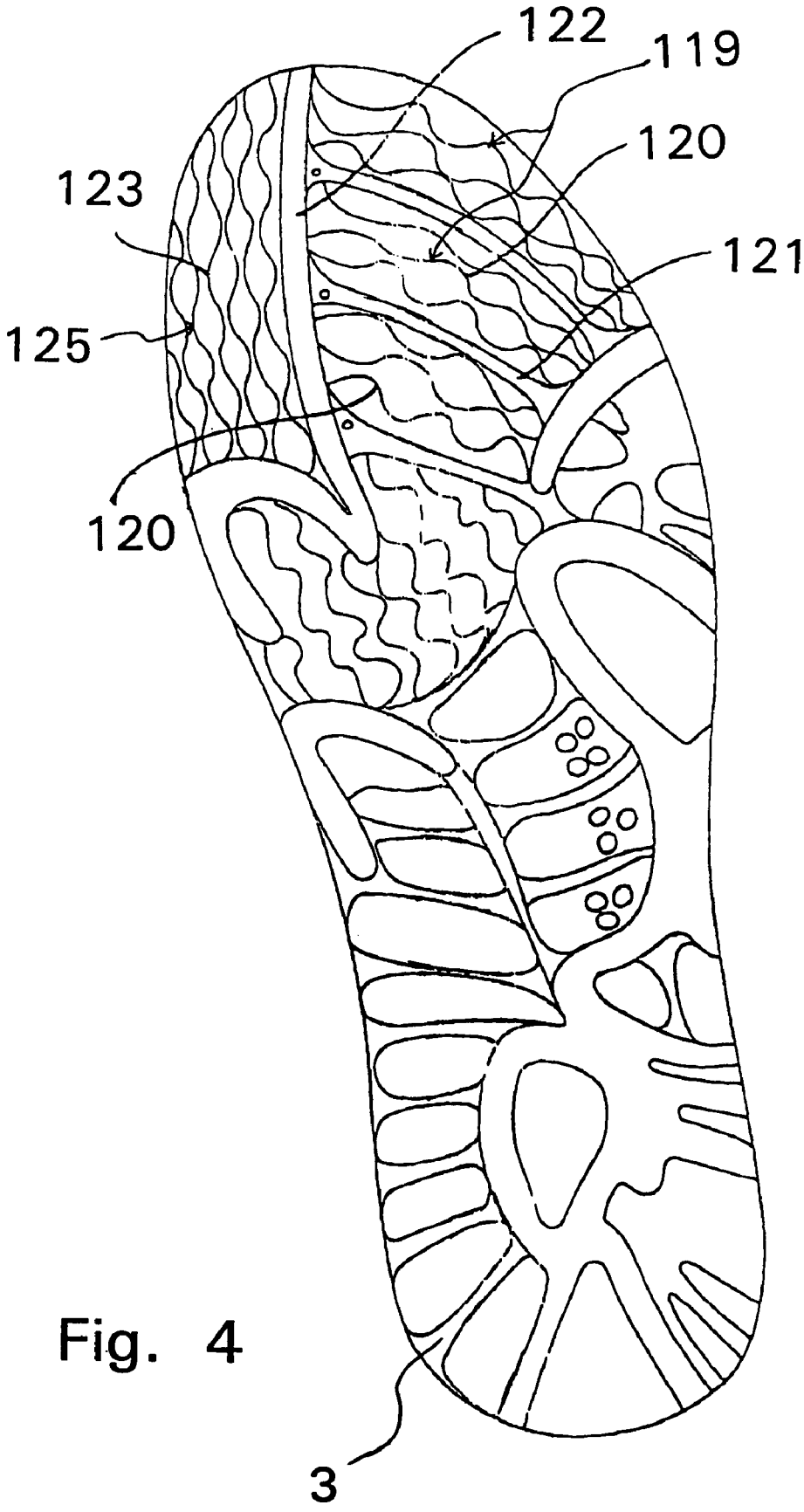
FIG. 4 is a top plan view of the sole of FIG. 1.
Figure 5:
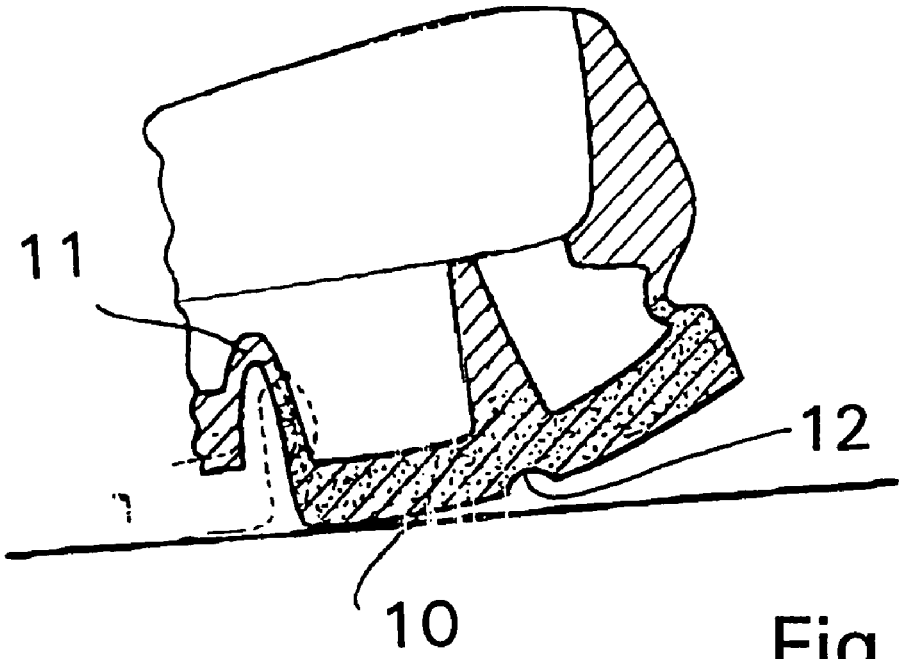
FIG. 5 is a sectional view taken along the plane 5—5 of FIG. 1.
Figure 6:
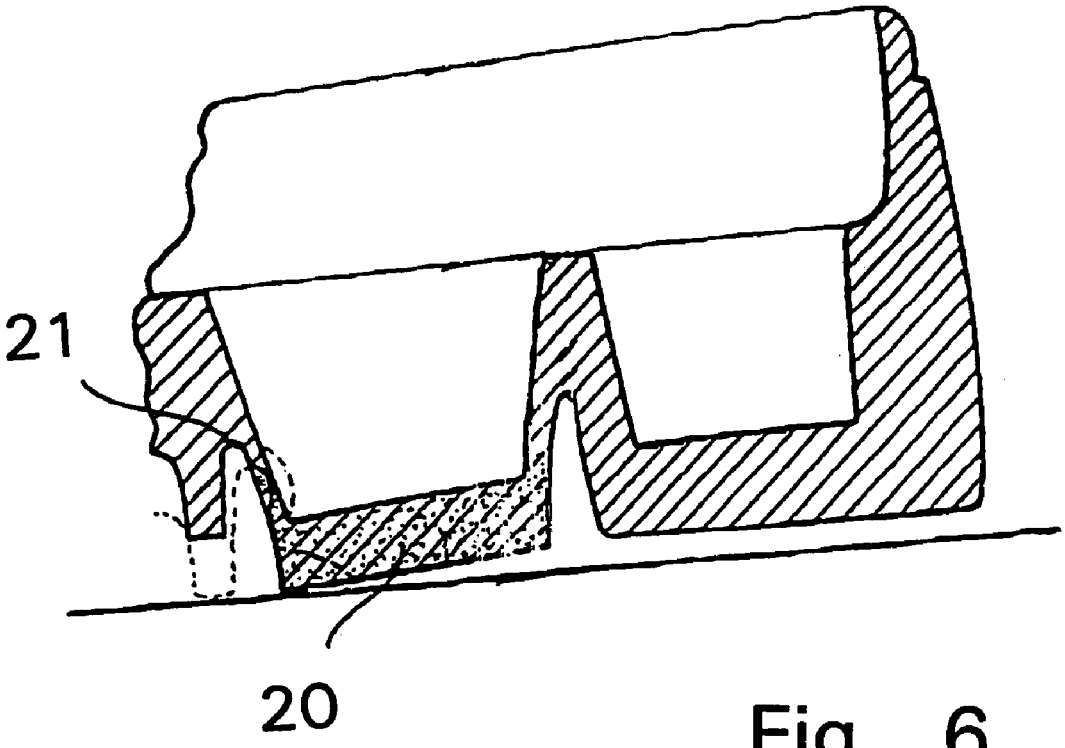
FIG. 6 is a sectional view taken along the plane 6—6 of FIG. 1.
Figure 7:
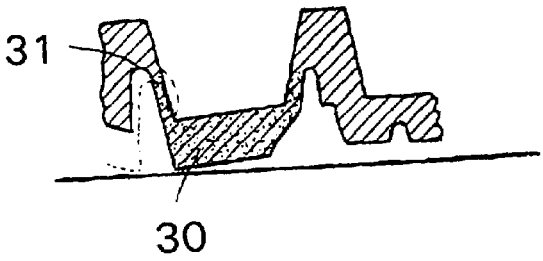
FIG. 7 is a sectional view taken along the plane 7—7 of FIG. 1.
Figure 8:
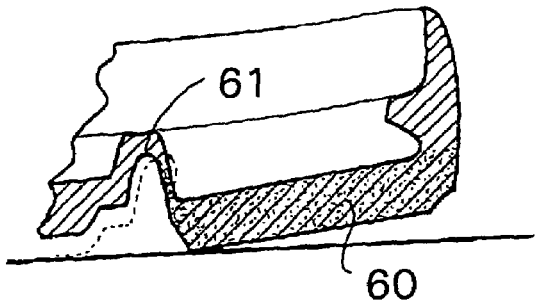
FIG. 8 is a sectional view taken along the plane 8—8 of FIG. 1.
Figure 9:
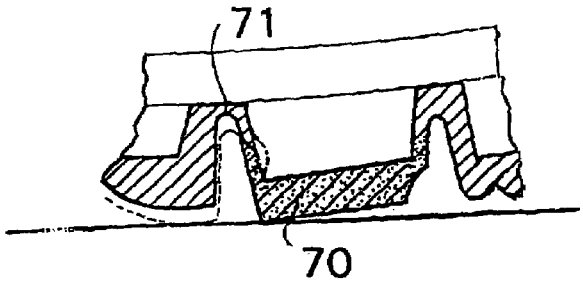
FIG. 9 is a sectional view taken along the plane 9—9 of FIG. 1.
Figure 10:
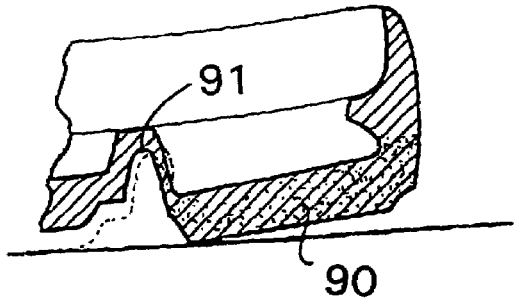
FIG. 10 is a sectional view taken along the plane 10—10 of FIG. 1.
Figure 11:
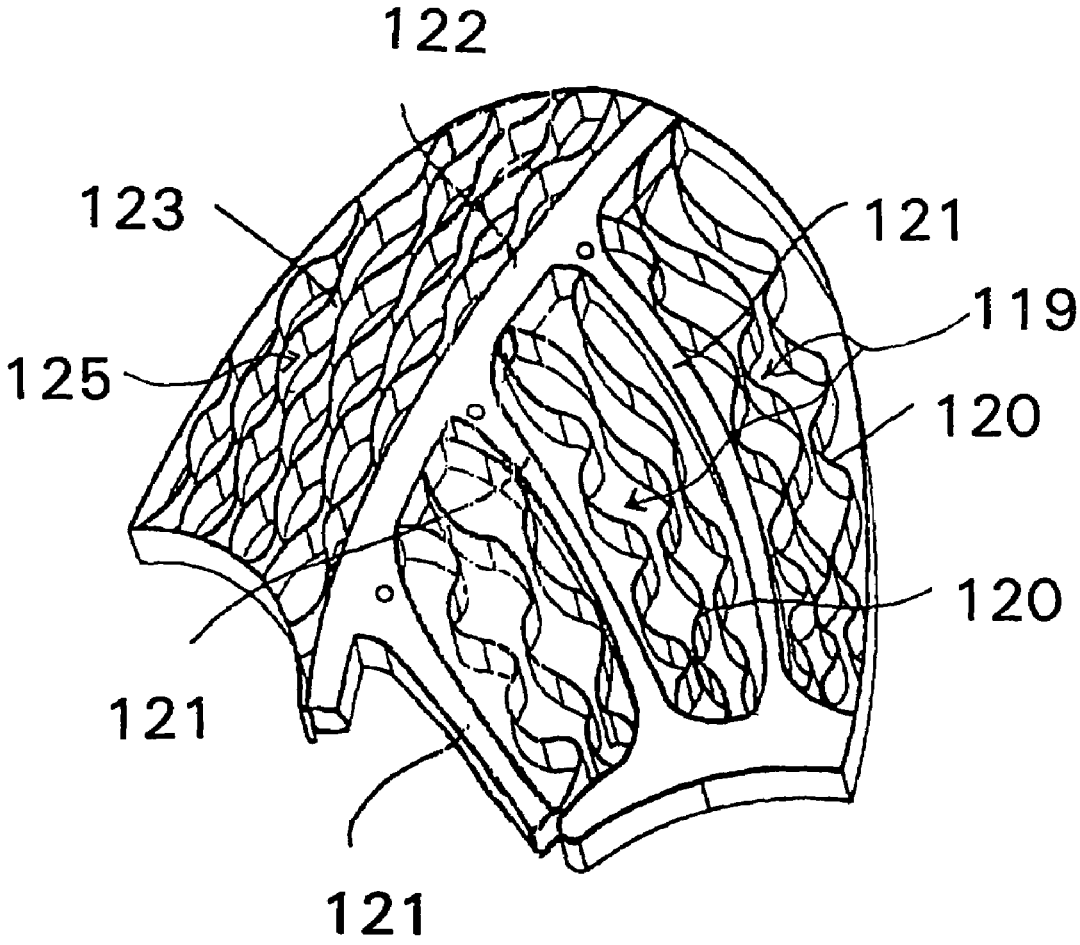
FIG. 11 is a schematic perspective view of the shape of the inner face of the sole at the tip.

As shown in FIGS. 4 and 11, the top surface 3 of the sole, which typically mates with or supports a conventional inner sole of the shoe (not shown), has a plurality of transverse lightenings 119. The transverse lightenings 119 include a longitudinal separation wall 122 that is shaped so as to be at least partially hollow. Due to this arrangement, the overall weight of the sole and the amount of material used to manufacture the shoe sole are reduced. The transverse lightenings 119 utilize the elastic characteristic of rubber to facilitate the absorption and the release of the compression energy. The transverse lightenings 119 have different functional areas and walls are created which separate the various groups of transverse lightenings 119 with different structural functions, radiating as supporting ribs along the lines where the sole requires greater thickness.

Furthermore, the transverse lightenings 119 may also be utilized to form the oscillation axes 12, 22, 32, 42, 52, 62, 72, 82, 92 of the various protrusions.

The transverse and longitudinal lightenings 119, 125 located in the ball of the foot section 6 and the toe section 7 have a plurality of thin wall undulations 120, 123. The undulations 120, 123 are shaped as opposing waves which tend to compress one another when subjected to pressure. The undulations 120, 123 are shaped and orientated in order to utilize the inherent elastic energy return of the material from which the sole is manufactured.

Particularly in the front portion of the sole, the transverse lightening 119, as shown in FIG. 11, have a structure shaped like mutually opposite undulations which compress each other when subjected to pressure. The transverse lightenings 119 are structured to facilitate the release of the energy accumulated along a predefined direction. That is, the undulations 120 located at the outer side of the ball of the foot region 6 and the toe region 7, extend at about a 45° angle to the longitudinal axis L of the sole 1, and are angled toward the big toe. A plurality of dividing walls 121 are provided between each group or set of three undulations 120. In practice, the dividing walls 121 constitute ribs which are meant to transfer the energy in a medial direction toward the longitudinal separation wall 122 which in practice delimits the medial undulations 123 provided in the region affected by the big toe.

A longitudinal lightening 125 is located below the big toe which includes the longitudinal undulations 123. Each of the longitudinal undulations 123 extends generally in a direction parallel to the longitudinal axis L of the sole 1. The longitudinal lightening 125, located below the big toe, is separated from the transverse lightenings 119 by the longitudinal separation wall 122. One end of each of the dividing walls 121 of the transverse lightenings 119 contacts or engages with the longitudinal separation wall 122 to facilitate transfer of the energy in a medial direction toward and along the longitudinal separation wall 122. All of the energy derived from the compression of the protrusions in the ball of the foot region 6 and the toe region 7 accumulates and is transferred toward the inner edge 104 and 105 to facilitate separation of the shoe sole from the ground. That is, the energy derived from the compression of the protrusions in the region accumulates in the opposite-undulation area and, during the final part of the ground contact step, the energy is transferred toward the edge 104 and 105 in its medial portion, facilitating separation.

It is possible that the undulations 120, 123 can be straight members rather than wavy members and still function in accord with the teaching of the present invention. In addition, it is to be appreciated that the undulations 120 and the dividing walls 121 function as fold lines to facilitate bending of the sole of the shoe therealong. In addition the longitudinal separation wall 122 also forms a fold line or folding area for the bottom portion of the sole of the shoe.

The top surface 3 of the sole cooperates with the protrusions 10, 20, 30,40, 50, 60, 70, 80, 90 so that, when the heel contacts the ground, each protrusion 10, 20, 30, 40, 50, 60, 70, 80, 90 is compressed and rotates about its own pivot axis. For example, the rear portion of the protrusion 10 flexes inward, while the front portion of the protrusion 10, which forms the vertex of the triangle, flexes outward, as shown in the cross-section of FIG. 5. Thus, this energy movement moves into the central protrusion 20. Similarly, the rear portion of the central protrusion 20 rotates and flexes inward, and the front portion rotates and flexes outward. The energy movement of the central protrusion 20 affects the inner lateral protrusion 30, whose rear part flexes inward while its front part flexes outward. This action subjects the bridge 37, between the inner lateral protrusion 30 to the forward arch protrusion 60, to traction and induces the outward flexing of the rear part of the protrusion. As soon as the pressure on the inner lateral protrusion 30 is released, the energy accumulated in the elastic connection is released and directed toward the forward arch protrusion 60 and the lateral planter protrusion 90.

When the front medial part of the lateral planter protrusion 90 flexes inward, this causes a stretching of the dividing walls 121. When the pressure on the lateral planter protrusion 90 decreases, the energy accumulated in the elastic connection is transferred in a forward direction along the three dividing walls 121 and reaches the longitudinal wall 122 where the energy is finally transferred forward to the front curved edge 105. While this is occurring, the weight of the user moves toward the inner edge causing the metatarsal protrusion 70 to be compressed. Thus, the metatarsal protrusion 70 flexes inward, subjecting to tension the elastic connection with the forward arch protrusion 60 which accordingly flexes inward. The absorbed energy passes to the undulations and, when the pressure on the metatarsal protrusion 70 is released, the forward arch protrusion 60 returns to its original position and the energy accumulated by the undulations passes to the front curved edge 105. Any compression energy applied by the big toe prior to lifting of the shoe sole, from contact with the ground, is added to the energy stored in the front curved edge 105. The energy accumulated by the edge 105 is released in the form of thrust and the sole expands when the big toe leaves the ground.

In the meantime, the weight moves medially and the protrusion 70 is compressed and flexes inward, subjecting to tension the elastic connection with the stud 80, which accordingly flexes inward.

The energy is released to the undulations and, when the pressure on the protrusion 70 is released because the big toe is about to rise, the protrusion 80 returns to its original position and the energy accumulated by the undulations passes to the front curved edge 105.

Figure 12:
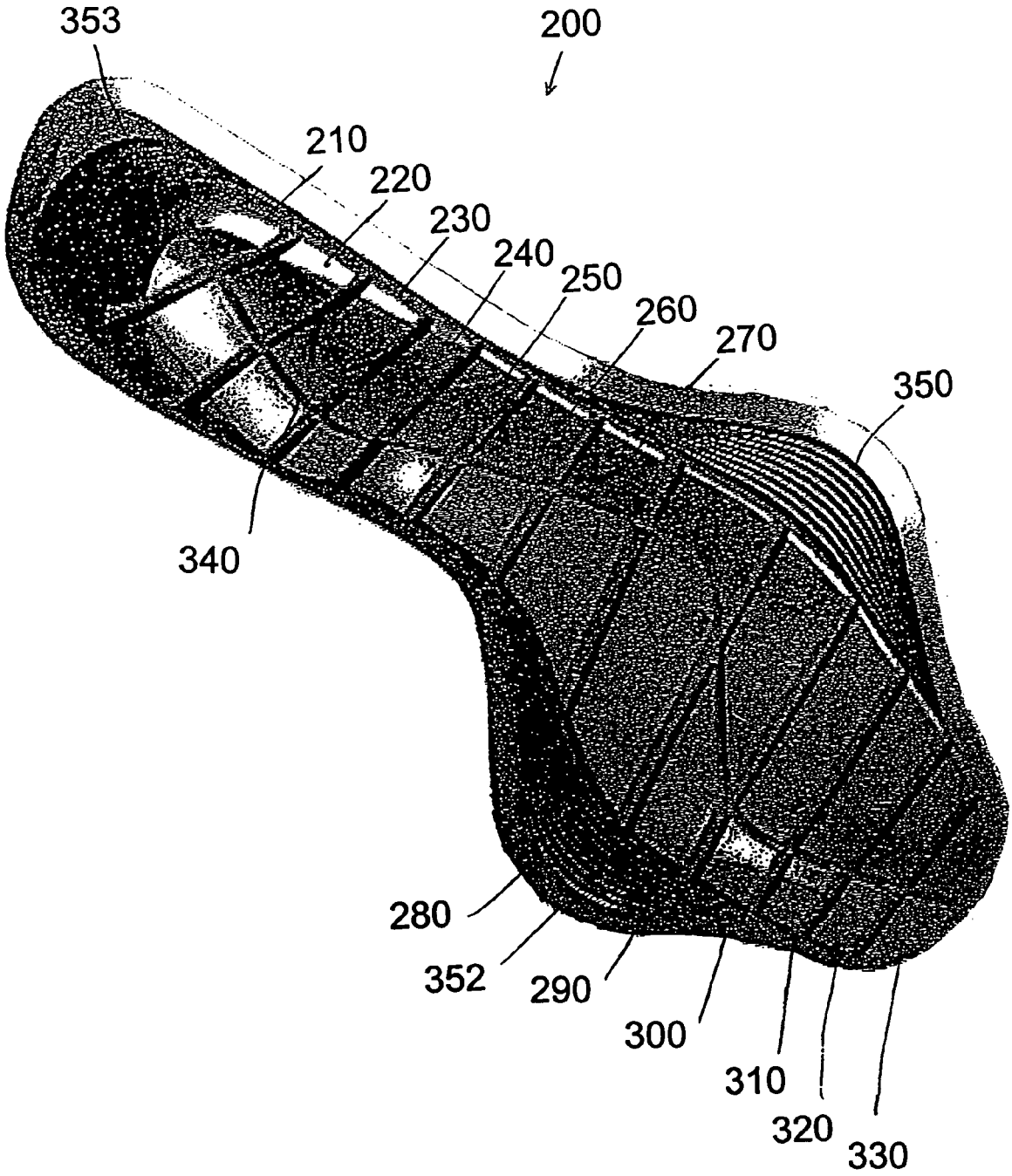
FIG. 12 is a diagrammatic bottom plan view of a second embodiment of the present invention showing a shoe sole for a woman's shoe.

As shown in FIG. 12, application of the above concepts are applied, by way of example, into a sole for a woman's shoe. The female sole 200 includes a plurality of shaped protrusions 210, 220, 230, 240, 250, 260, 270, 280, 290, 300, 310, 320, 330. The protrusions include flat portions which are disposed near a perimeter of each protrusion 210, 220, 230, 240, 250, 260, 270, 280, 290, 300, 310, 320, 330. A medial portion of each protrusion 210, 220, 230, 240, 250, 260, 270, 280, 290, 300, 310, 320, 330 is angled upward, toward the foot of the user. Each protrusion 210, 220,.230, 240, 250, 260, 270, 280, 290, 300, 310, 320, 330 is divided by a serpentine channel 340 which extends longitudinally along the length of the shoe sole. Additionally, a plurality of downward facing ribs 350, 352, 353 are provided and located adjacent to the user's foot and extending laterally from either side of the ball of the foot portion and extending rearwardly from the heel portion. These downward facing ribs 350, 352, 353 act to center multiple foot structures. Multiple foot shapes can automatically center themselves in the shoe by moving the flex zones positioned at the location that covers the borders of the first metatarsal head and the borders of the fifth metatarsal tuberosity. The shoe sole creates a multi last function with structured support and guidance. The heel flex zone is positioned laterally for accommodation of rotation of the transverse arch during toe off. Multiple structures move the heel laterally from internal rotation of the transverse arch before toe off, this creates internal sheering of the shoe counter and heel. The flex zone allows the shoe heel zone to adjust to heel motion, reducing this sheering of material against the skin.

The altering of the shoe sole from round edge to a sharp angled foot guiding sole border can also be achieved by changing the internal and external flex characteristics of the boarders between the two zones. For example, the outer side lateral heel border can be shaped or formed with a small angle to resemble the inner side medial heel portion, but the foot guiding roll zone function can be achieved by altering the flexibility of internal midsole and thickness in the outer sole borders of the lateral roll zone to flex inward under force moving the entire zone inward from posterior to anterior as the foot moves from a heel strike to the intermediate phase stance, while the medial angled section will not have any flexible borders. The function of a lateral roll zone with a medial stabilized heel is achieved. In this way, the flex characteristics can be changed throughout the entire sole border and, by altering sectional border zones from flexible to rigid, this further facilitates guiding the desired direction of the foot from heel strike to toe off.

For example, a lateral anterior rigid sole section with a posterior and medial flexible section will guide the sole to move the foot medially. The altering flex zones can enhance foot guidance of all types of shoe soles. In both women's and men's heels, a small section of the heel portion can be divided, from top to bottom, with a flexible channel that creates a heel that moves a lateral section inward and or upward to form the roll zone effect. As the sole ramps downward, the lateral borders just posterior, medial and anterior to the tuberosity of the fifth metatarsal head, can be flexible to guide the tuberosity section of the foot downward during the intermediate stance phase. The sole border flexibility, just posterior to the first metatarsal, will suspend the first metatarsal downward while allowing the metatarsal head to roll forward and suitably position for toe off.

An overview of the present invention is as follows. From the instance when the heel portion initially strikes the ground, through the intermediate stance phase and to toe off, the shoe sole zones, with properly placed sectional flex zones with bordering rigid supportive zones, can facilitate guidance of the foot through a path of least resistance from heel strike to toe off. By suitably shaping, sizing, orientating and locating the protrusions as well as suitably shaping, sizing, orientating and locating the oscillation axis, a desired path designed to guide a particular foot during a particular motion can be readily achieved, e.g., the motion of a foot in a running shoe will be different from the motion of a foot in a tennis shoe.

For the plantar outer sole protrusions, it is to be appreciated that the protrusions can also be 1) angled, non-moving protrusions, 2) non-angled but moving protrusions made from flexible with apposing rigid protrusion borders, 3) angled and moving protrusions flexible and apposing rigid borders, 4) angled with complete compression borders or 5) non angled with complete flexible borders. It is to be appreciated that the inherent characteristics of all of the protrusions can be altered from compressed air, midsole flexibility, internal outer sole voids in wall structures (weight relief) rigid and flexible rubber, EVA and plastic type materials placed to resist and create foot movement for guidance.

The protrusions with foot motion altering characteristics are strategically placed in and on the outer sole can form multiple foot guiding paths from heel strike to toe off. For example, in order to guide a standard walking path (using different protrusions with a 6 protrusion layout), a lateral posterior impact protrusion is placed at the most posterior slightly outer lateral section of the sole. This lateral posterior impact protrusion can have a flexible border throughout its entire circumference so that the protrusion, upon impact, moves completely inward relative to the sole to guide the foot laterally to the lateral roll zone (this protrusion could be advanced with a pivot point located proximal to the center of the protrusion). It is to be appreciated that the pivot point could be an internal member or bar dividing the protrusion in two sections, an anterior and a posterior section. Upon impact, the protrusion compresses the posterior section inward while propelling the anterior protrusion section outward and downward guiding the foot laterally and forward.

The 6 protrusion layout further includes a center heel protrusion. The center heel protrusion is a non-angled protrusion which may have a flexible anterior border section angled slightly laterally, while having a rigid posterior border angled slightly medially. As the foot moves forward towards the intermediate stance phase, following impact, the anterior portion of the protrusion will compress inward and laterally while the posterior medial section maintains an angle that guides the foot laterally away to prevent early pronation.

In addition, the 6 protrusion layout has two apposing protrusions which work together to guide the foot through the intermediate stance phase. The protrusion located at the anterior lateral heel posterior, but proximal to the tuberosity of the fifth metatarsal head, can have a complete flexible border compressing the protrusion inward during the intermediate stance phase. This compression will guide and suspend the tuberosity of the foot's fifth metatarsal head downward and forward. During such compression, a laterally angled medial protrusion located at the most lateral posterior section of the outer sole's anterior section just proximate to the anterior fifth metatarsal head, can have a flexible border throughout its entire circumference. As the foot completes its intermediate stance phase, this protrusion maintains lateral foot suspension while guiding the foot medially towards the toe off phase. During the intermediate stance phase, the two protrusions work together in conjunction with one another to maintain the suspension of the fifth metatarsal resisting internal lateral pressure that can cause early pronation (this is a similar effect by using protrusions that compress inward to create a downward flex zone in this area for high heels as described above).

The 6 protrusion layout also includes a non moving angled guidance protrusion located at the anterior of the sole most lateral section, proximate and anterior to the anterior sole's posterior suspension protrusion. This protrusion is angled with a high point thereof sloping laterally downward medially, guiding the foot medially so as to resist supination.

Finally, the 6 protrusion layout includes a first metatarsal suspension protrusion, located at the anterior sole's most medial posterior section proximate to the head of the first metatarsal. A border of the first metatarsal protrusion has a flexible circumference which, upon compression, the first metatarsal protrusion moves inward suspending the first metatarsal downward while guiding the foot forward to a levered toe off stage. It is to be appreciated that a more advanced version may have internal pivot bar that divides the protrusion in an anterior section and a posterior section. Upon compression, the posterior section moves inward while the anterior section moves outward forming an anterior angle to facilitate braking on downward inclines. When moving up an incline, the anterior section may move inward while the posterior section moves outward forming a posterior angle that offers a gripping function, while guiding the first metatarsal head to roll for and aft with the least resistance to toe off.

From what has been described above in the two embodiments of the present invention, it is thus evident that the invention achieves the intended aim and objects and, in particular, the fact is stressed that a sole for shoes is provided which, by virtue of the particular design of the protrusions, which form movable elements, it is possible to provide a very precise guiding for the foot so as to follow the path for the foot that is ideal for the specific use or intent of the shoe.

The invention thus conceived is susceptible to numerous modifications and variations, all of which are within the scope of the inventive concept. In addition, it is to be appreciated, by those skilled in this art, that one or more of the specifically disclosed elements or features may be replaced by other technically equivalent elements or features.

Each one of the oscillation axis is generally formed along an interface between the weaker portion and the stronger portion or by a reduction in a wall thickness of the protrusion.

In practice, the material used, so long as they are compatible with the specific use, as well as the contingent shapes and dimensions, may be any according to the requirements.

While specific embodiments of the invention have been described in detail, it will be appreciated by those skilled in the art that various modifications and alternatives to those details could be developed in light of the overall teachings of the disclosure. For example, the materials used in construction of the sole 1 may vary, so long as the materials are compatible with the specific use. Similarly, the shapes and dimensions of the various protrusions may also vary. Accordingly, the particular arrangements disclosed are meant to be illustrative only and not limiting as to the scope of the invention which is to be given the full breadth of the claims appended and any and all equivalents thereof.

The invention claimed is:

1. A shoe sole comprising:

a sole body having a top inner sole engaging surface and a bottom ground engaging surface and an inner lateral side and an outer lateral side, and the sole body having a heel section, an arch section, a ball of a foot section and a toe section;

the bottom ground engaging surface supporting at least one protrusion;

the at least one protrusion being supported by the sole so as to form an oscillation axis which facilitates pivoting of the at least one protrusion relative to the sole; and the oscillation axis of the at least one protrusion is formed by supporting the at least one protrusion by a relatively stronger portion of the shoe sole and a relatively weak portion of the shoe sole with an interface between the relatively stronger portion and the relatively weaker portion forming the oscillation axis which facilitates pivoting of the at least one protrusion.

2. A shoe sole comprising:

a sole body having a top inner sole engaging surface and a bottom ground engaging surface and an inner lateral side and an outer lateral side, and the sole body having a heel section, an arch section, a ball of a foot section and a toe section;

the bottom ground engaging surface supporting at least one protrusion;

the at least one protrusion being supported by the sole so as to form an oscillation axis which facilitates pivoting of the at least one protrusion relative to the sole; and the oscillation axis of the at least one protrusion is formed by a sidewall of the at least one protrusion having at least two different yield configurations that form the oscillation axis which facilitates pivoting of the at least one protrusion.

3. The shoe sole according to claim 2, wherein the oscillation axis of the at least one protrusion is formed by a sidewall of the at least one protrusion having a flexible portion which forms the oscillation axis and facilitates pivoting of the at least one protrusion.

4. A shoe sole comprising:

a sole body having a top inner sole engaging surface and a bottom ground engaging surface and an inner lateral side and an outer lateral side, and the sole body having a heel section, an arch section, a ball of a foot section and a toe section;

the bottom ground engaging surface supporting at least one protrusion;

the at least one protrusion being supported by the sole so as to form an oscillation axis which facilitates pivoting of the at least one protrusion relative to the sole; and the oscillation axis of the at least one protrusion is formed by an internal member or bar dividing the at least one protrusion into two sections which forms the oscillation axis and facilitates pivoting of the at least one protrusion.

5. The shoe sole according to claim 2, wherein the shoe sole includes a plurality of protrusions which are flexible and each define an oscillation axes which produces a guide sequence of the foot from an instance when the heel section of the shoe sole initiates contact with a ground engaging surface to an instance when a front edge of the shoe sole break contact with the ground surface.

6. The shoe sole according to claim 2, wherein the arch section is located between the heel section and the ball of the foot section, and the arch section forms a bridge for the shoe sole whereby at least a portion of the arch section is spaced from the ground surface during use of the shoe sole.

7. The shoe sole according to claim 2, wherein a plurality of protrusions are formed in the heel section and at least one of the plurality of protrusions has a sharp edge to facilitate one of sloping and gripping of the ground surface, and at least one of the plurality of protrusions in the shoe sole section has a sharp edge to facilitate one of stopping and gripping.

8. The shoe sole according to claim 2, wherein at least two protrusions are supported by the shoe sole so as to form an oscillation axis which facilitates pivoting of each one of the at least two protrusions to impart directionality to a foot of a wearer thereby guiding the foot along a desired path.

9. A shoe sole comprising:

a sole body having a top inner sole engaging surface and a bottom ground engaging surface and an inner lateral side and an outer lateral side, and the sole body having a heel section, an arch section, a ball of a foot section and a toe section;

the bottom ground engaging surface supporting at least one protrusion;

the at least one protrusion being supported by the sole so as to form an oscillation axis which facilitates pivoting of the at least one protrusion relative to the sole; and at least one protrusion in the heel section guides foot motion toward the lateral outside of the arch section, at least one protrusion, located in the arch section of the shoe sole, guide foot movement toward the inner lateral side of the ball of the foot section and at least one protrusion, located in the ball of the foot section, guides foot movement toward the toe section to move the foot along the path.

10. The shoe sole according to claim 9, wherein a portion of the lateral side of the ball of the foot section has a sharp edge region while a portion of the inner lateral side of the ball of the foot section has a rounded edge region.

11. A shoe sole comprising:

a sole body having a top inner sole engaging surface and a bottom ground engaging surface and an inner lateral side and an outer lateral side, and the sole body having a heel section, an arch section, a ball of a foot section and a toe section;

the bottom ground engaging surface supporting at least one protrusion;

the at least one protrusion being supported by the sole so as to form an oscillation axis which facilitates pivoting of the at least one protrusion relative to the sole; and the at least one protrusion is supported by the shoe sole such that as at least one protrusion pivots about the oscillation axis, the at least a portion of the at least one protrusion is compressed into the shoe sole and thereby causes distortion of the inner sole engaging surface of the shoe sole.

12. A shoe sole comprising:

a sole body having a top inner sole engaging surface and a bottom ground engaging surface and an inner lateral side and an outer lateral side, the sole body having a heel section, an arch section, a ball of a foot section and a toe section;

the bottom ground engaging surface supporting at least first at and second protrusions, the first and second protrusions each being supported by the shoe sole so as to form oscillation axes to guide foot motion during use of the shoe sole with the first protrusion guiding the foot, during use of the shoe sole, in a first direction, while the second protrusion guiding the foot, during use of the shoe sole, in a second different direction; and the oscillation axis of at least the first protrusion is formed by supporting the first protrusion by a relatively stronger portion of the shoe sole and a relatively weak portion of the shoe sole with an interface between the relatively stronger portion and the relatively weaker portion forming the oscillation axis which facilitates pivoting of the at least one protrusion.

13. The shoe sole according to claim 12, wherein the bottom ground engaging surface supporting at least first and second protrusions, the first protrusion being supported by the sole so as to be incompressible between the ground engaging surface and inner sole engaging surface, the second protrusion being supported by the shoe sole so as to form an oscillation axis to guide foot motion during use of the shoe sole in a first direction.

14. The shoe sole according to claim 12, the bottom ground engaging surface supporting at least first and second protrusions, the first protrusion being supported by the sole so as to be incompressible between the ground engaging surface and inner sole engaging surface, the second protrusion being supported by the shoe sole so as to be compressible between the ground engaging surface and inner sole engaging surface to guide foot motion during use of the shoe sole in a first direction.

15. The shoe sole according to claim 12, wherein the oscillation axis of at least the first protrusion is formed by a sidewall of the first protrusion having a flexible portion which forms the oscillation axis and facilitates pivoting of the first protrusion.

16. A shoe sole comprising:

a sole body having a top inner sole engaging surface and a bottom ground engaging surface and an inner lateral side and an outer lateral side, the sole body having a heel section, an arch section, a ball of a foot section and a toe section;

the bottom ground engaging surface supporting at least first and second protrusions, the first and second protrusions each being supported by the shoe sole so as to form oscillation axes to guide foot motion during use of the shoe sole with the first protrusion guiding the foot, during use of the shoe sole, in a first direction, while the second protrusion guiding the foot, during use of the shoe sole, in a second different direction; and the oscillation axis of at least the first protrusion is formed by a sidewall of the first protrusion having at least two different yield configurations that form the oscillation axis which facilitates pivoting of the at least one protrusion.

17. A shoe sole comprising:

a sole body having a top inner sole engaging surface and a bottom ground engaging surface and an inner lateral side and an outer lateral side, the sale body having a heel section, an arch section, a ball of a foot section and a toe section;

the bottom ground engaging surface supporting at least first and second protrusions, the first and second protrusions each being supported by the shoe sole so as to form oscillation axes to guide foot motion during use of the shoe sole with the first protrusion guiding the foot, during use of the shoe sole, in a first direction, while the second protrusion guiding the foot, during use of the shoe sole, in a second different direction; and the oscillation axis of the at least one protrusion is formed by an internal member or bar dividing the at least one protrusion into two sections which forms the oscillation axis and facilitates pivoting of the at least one protrusion.

18. The shoe sole according to claim 12, wherein the arch section is located between the heel section and the ball of the foot section, and the arch section forms a bridge for the shoe sole whereby at least a portion of the arch section is spaced from a ground surface during use of the shoe sole.

19. The shoe sole according to claim 12, wherein one the first and second protrusions in located in the heel section and has sharp edge to facilitate stopping and gripping of a ground surface and the other the first and second protrusions is located in the toe section and has a sharp edge to facilitate one of stopping and gripping.

20. The shoe sole according to claim 12, wherein inner lateral side of the heel section has a sharp edge region while an outer lateral side of the heel section has a rounded edge region.

21. The shoe sole according to claim 12, wherein a portion of the outer lateral edge of the ball of the foot section has a sharp edge region while a portion of the inner lateral side of the ball of the foot section has a rounded edge region.

22. The shoe sole according to claim 12, wherein at least one of the first and second protrusions is flexible and defines a rotational axis for one of the first and second protrusions.

23. A shoe sole comprising:

a sole body having a top inner sole engaging surface and a bottom ground engaging surface and an inner lateral side and an outer lateral side, the sole body having a heel section, an arch section, a ball of a foot section and a toe section;

the bottom ground engaging surface supporting at least first and second protrusions, the first and second protrusions each being supported by the shoe sole so as to form oscillation axes to guide foot motion during use of the shoe sole with the first protrusion guiding the foot, during use of the shoe sole, in a first direction, while the second protrusion guiding the foot, during use of the shoe sole, in a second different direction; and at least one protrusion is supported by the shoe sole such that as at least one protrusion pivots about the oscillation axis, at least a portion of the at least one protrusion is compressed into the shoe sole and thereby causes distortion of the inner sole engaging surface of the shoe sole.

24. A shoe sole comprising:

a sole body having a top inner sole engaging surface and a bottom ground engaging surface and an inner lateral side and an outer lateral side, and the sole body having a heel section, an arch section, a ball of a foot section and a toe section;

the bottom ground engaging surface supporting at least one protrusion;

the at least one protrusion being a heel protrusion located substantially within the center of the heel section, and the heel protrusion has a substantially rigid connection with the sole whereby the heel protrusion induces a biasing force on the foot for guiding the foot in a desired direction upon use of the shoe sole; and oscillation axis of the heel protrusion is formed by supporting the heel protrusion by a relatively stronger portion of the shoe sole and a relatively weak portion of the shoe sole with an interface between the relatively stronger portion and the relatively weaker portion forming the oscillation axis which facilitates pivoting of the at least one protrusion.

25. A shoe sole comprising:

a sole body having a top inner sole engaging surface and a bottom ground engaging surface and an inner lateral side and an outer lateral side, and the sole body having a heel section, an arch section, a ball of a foot section and a toe section;

the bottom ground engaging surface supporting at least one protrusion;

the at least one protrusion being a heel protrusion located substantially within the center of the heel section, and the heel protrusion has a substantially rigid connection with the sole whereby the heel protrusion induces a biasing force on the foot for guiding the foot in a desired direction upon use of the shoe sole; and an oscillation axis of the heel protrusion is formed by a sidewall of the heel protrusion having at least two different yield configurations that form the oscillation axis which facilitates pivoting of the at least one protrusion.

26. The shoe sole according to claim 25, wherein the oscillation axis of the heel protrusion is formed by a sidewall of the heel protrusion having a flexible portion which forms the oscillation axis and facilitates pivoting of the at least one protrusion.

27. A shoe sole comprising:

a sole body having a top inner sole engaging surface and a bottom ground engaging surface and an inner lateral side and an outer lateral side, and the sole body having a heel section, an arch section, a ball of a foot section and a toe section;

the bottom ground engaging surface supporting at least one protrusion;

the at least one protrusion being a heel protrusion located substantially within the center of the heel section, and the heel protrusion has a substantially rigid connection with the sole whereby the heel protrusion induces a biasing force on the foot for guiding the foot in a desired direction upon use of the shoe sole; and an oscillation axis of the at least one protrusion is formed by an internal member or bar dividing the at least one protrusion into two sections which forms the oscillation axis and facilitates pivoting of the at least one protrusion.

28. The shoe sole according to claim 25, wherein the shoe sole includes a plurality of protrusions which are flexible and each define an oscillation axes which produces a guide sequence of the foot from an instance when the heel section of the shoe sole initiates contact with a ground engaging surface to an instance when a front edge of the shoe sole break contact with the ground surface.

29. The shoe sole according to claim 25, wherein the arch section is located between the heel section and the ball of the foot section, and the arch section forms a bridge for the shoe sole whereby at least a portion of the arch section is spaced from the ground surface during use of the shoe sole.

30. The shoe sole according to claim 25, wherein a plurality of protrusions are formed in the heel section and at least one of the plurality of protrusions has a sharp edge to facilitate one of sloping and gripping of the ground surface, and at least one of the plurality of protrusions in the shoe sole section has a sharp edge to facilitate one of stopping and gripping.

31. The shoe sole according to claim 25, wherein at least two protrusions are supported by the shoe sole so as to form an oscillation axis which facilitates pivoting of each one of the at least two protrusions to impart directionality to a foot of a wearer thereby guiding the foot along a desired path.

32. A shoe sole comprising:

a sole body having a top inner sole engaging surface end a bottom ground engaging surface and an inner lateral side and an outer lateral side, and the sole body having a heel section, an arch section, a ball of a foot section and a toe a section;

the bottom ground engaging surface supporting at least one protrusion;

the at least one protrusion being a heel protrusion located substantially within the center of the heel section, and the heel protrusion has a substantially rigid connection with the sole whereby the heel protrusion induces a biasing force on the foot for guiding the foot in a desired direction upon use of the shoe sole; and at least one protrusion in the heel section guides foot motion toward the lateral outside of the arch section, at least one protrusion, located in the arch section of the shoe sole, guide foot movement toward the inner lateral side of the ball of the foot section and at least one protrusion, located in the ball of the foot section, guides foot movement toward the toe section to move the foot along the path.

33. The shoe sole according to claim 32, wherein a portion of the lateral side of the ball of the foot section has a sharp edge region while a portion of the inner lateral side of the ball of the foot section has a rounded edge region.

* * * * *